United States Patent [19]

Coyle, Sr.

[11] 4,354,706

[45] Oct. 19, 1982

[54] DUAL STRING ELEVATORS

[75] Inventor: William E. Coyle, Sr., Houma, La.

[73] Assignee: Bilco Tools, Inc., Houma, La.

[21] Appl. No.: 155,477

[22] Filed: Jun. 2, 1980

[51] Int. Cl.[3] ..... E21B 19/07

[52] U.S. Cl. ..... 294/102 A; 24/263 CA; 294/90

[58] Field of Search ..... 294/86.1, 87 R, 90, 294/102 R, 102 A; 24/249 DP, 263 R, 263 CA, 263 D, 263 DA, 263 DC, 263 SW; 166/75 A, 77.5, 85, 313

[56] References Cited

U.S. PATENT DOCUMENTS

| | | | |
|---|---|---|---|
| 1,762,037 | 6/1930 | Taylor | 24/249 DP |
| 2,298,507 | 10/1942 | Penick et al. | 294/102 A X |
| 3,149,391 | 9/1964 | Boster | 24/263 CA |
| 3,154,146 | 10/1964 | Brown | 166/313 |
| 3,188,708 | 6/1965 | O'Haver | 24/263 R |
| 3,197,835 | 8/1965 | Brown | 24/263 CA |
| 3,287,776 | 11/1966 | Brown | 294/90 X |
| 3,330,354 | 7/1967 | Chamblee | 166/313 |
| 3,976,132 | 8/1976 | Harper | 24/263 R X |

*Primary Examiner*—Johnny D. Cherry
*Attorney, Agent, or Firm*—Vinson & Elkins

[57] ABSTRACT

A dual string elevator having a body with a pair of tapered bowls extending vertically therethrough, lifting projections extending outward from the body in positions aligned with the bowls to prevent bending of a string supported in one of the bowls, a set of gripping slips for each bowl, an actuator for each set of gripping slips, each actuator being mounted in a recess in the body aligned with and spaced outward from the bowls and pivotal links for connecting the actuators to their set of gripping slips whereby the slips are moved out of the bowls and lowered into the bowls into pipe gripping position responsive to the movement of the actuators.

3 Claims, 3 Drawing Figures

52
36
38
54
40
42
50
42
44
46
32
18
24
28
30
32
22
32
30
34
30
18
18
20
28
26
10
66
58
14
58
56
60
64
48
56
60
62
66
62
12

DUAL STRING ELEVATORS

BACKGROUND

The handling of cementing and production tubing at a wellhead has been done with the aid of an elevator. Prior elevators have handled single, dual and multiple strings. The C. C. Brown U.S. Pat. No. 3,154,145, the E. C. Chamblee U.S. Pat. No. 3,330,354 and the A. J. Penick U.S. Pat. No. 2,298,507 disclose examples of such prior elevators.

Elevators are used for supporting pipe strings in a well, when the string is being made up or broken out, lowering the string into the well and withdrawing the string from the well. Prior devices have used a body with one or more tapered bowls, a set of gripping slips for each bowl, an actuator to raise and lower the gripping slips with respect to their bowl and a means connecting to the body for supporting the elevator.

Disadvantages of the prior art structures which have been encountered are the tendency to bend tube strings when only one string is supported in a dual bowl elevator, damage encountered to the actuators as a result of being hit by the strings or tongs, and the failure of the actuators when lifting the gripping slips from the bowl to cause the main slip segment to be moved outward of the bowl.

SUMMARY

The present invention relates to an improved dual string elevator having a body with a pair of bowls and recesses in the body to receive the actuators, a pair of gripping slips, linkages connected to the gripping slips, the body and the actuators to move the main slip element radially outward from its bowl in being raised out of its bowl and lifting connections on the body aligned with the axes of the two bowls to prevent tilting of the elevator when loaded only in one bowl.

An object of the present invention is to provide an improved dual string elevator in which off-center loads do not cause the string supported therein to be bent.

A further object is to provide an improved elevator with gripping slip actuators which are protected from damage during use.

Another object of the present invention is to provide an improved well string elevator having an actuator to raise and lower the gripping slips in their bowl and which moves the main slip element radially outward from the bowl so that it does not interfere with the movement of a well string through the bowl when the gripping slips are raised.

BRIEF DESCRIPTION OF THE DRAWINGS

These and other objects and advantages of the present invention are hereinafter set forth and explained with respect to the drawings wherein.

DESCRIPTION OF THE PREFERRED EMBODIMENTS

Figure 1:
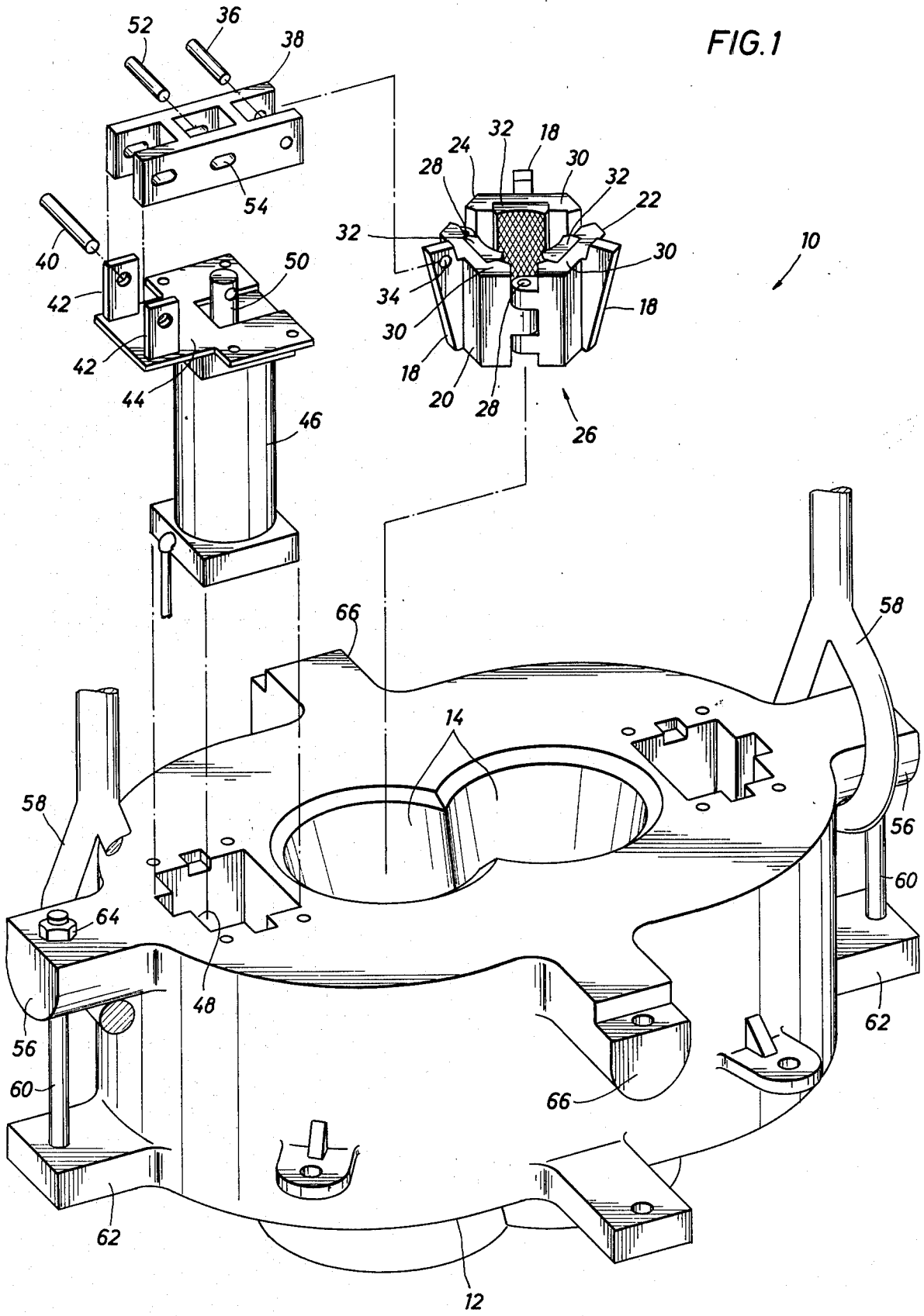
FIG. 1 is an isometric exploded view of the improved dual string elevator of the present invention with one of the gripping slips and its actuator being omitted for purpose of clarity.

Elevator 10 shown in the drawings is the preferred form of a dual string elevator of the present invention. Elevator 10 includes body 12 having bowls 14 extending vertically therethrough with tapered walls 16 which coact with tapered wedges 18 on the exterior of each slip 20, 22 and 24 of each gripping slip 26. Gripping means 26 include main slip 20 and side slips 22 and 24 pivotally connected by pins 28 to main slip 20. Suitable means, such as cotter pins (not shown) are provided to retain pins 28 in engagement between slip 20 and slips 22 and 24. Each slip includes back 30 with wedge 18 secured to the exterior thereof by welding or other suitable means and gripping elements 32 secured on the inner surface of back 30 as shown.

The upper end of each wedge 18 on main slips 20 has hole 34 therethrough to receive pin 36 which connects the end of link 38 to gripping slip 26. The opposite end of link 38 is connected by pin 40 to brackets 42 extending upward from plate 44. Plate 44 is secured to the upper end of actuator 46 and is secured by cap screws 47 to body 12 with actuator 46 positioned in recess 48 in body 12. Rod 50 extends from actuator 46 and is connected by pin 52 to central slots 54 in link 38. Pins 36, 40 and 52 include means to retain them in engagement with link 38 and gripping slips 26, brackets 42 and rod 50, respectively, such as cotter pins or snap rings (not shown).

Figure 3:
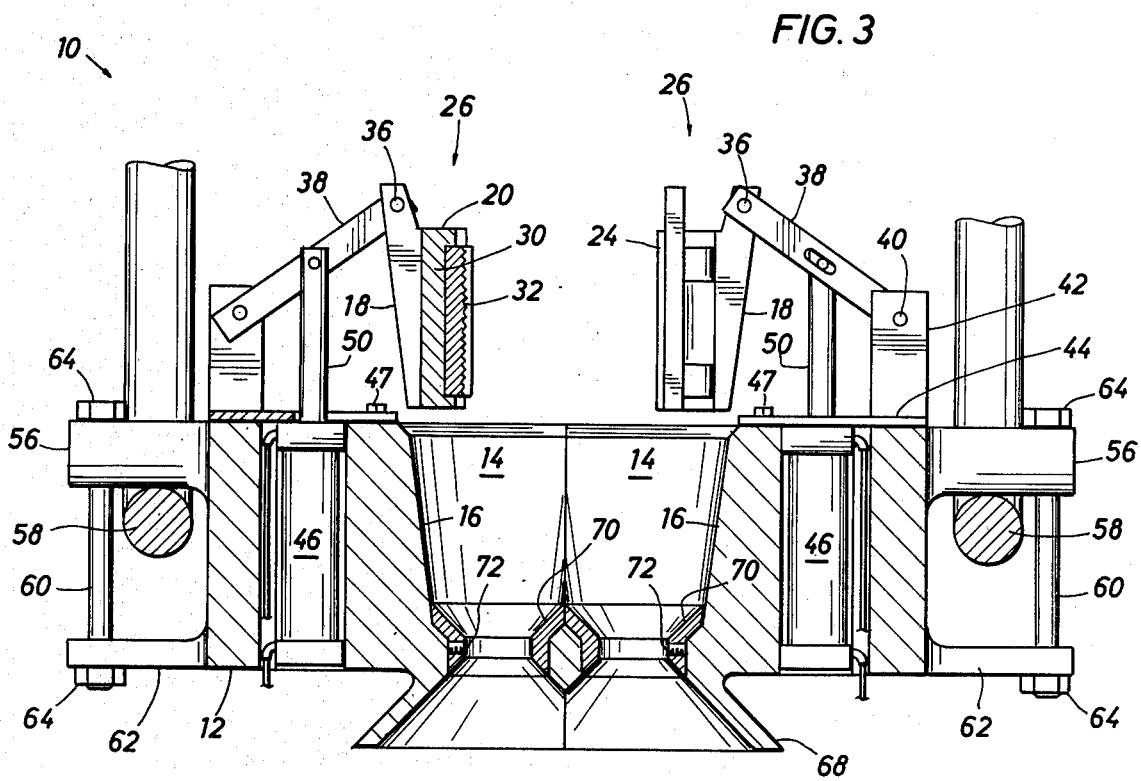
FIG. 3 is a similar sectional view illustrating the raising of the gripping slips from their bowls and their outward movement with respect to their bowls.

Projections 56 extend outward from body 12 and are aligned with the centers or axes of bowls 14 so that when a string T is supported in one of bowls 14 it is not subjected to bending because the load of only one string is not offset from the support line. Bails 58 encircle projections 56 and are secured in such position by studs 60 which extend through projections 56 and lower projections 62 and are held in position by nuts 64 threaded on the ends of studs 60 extending above projection 56 and below projection 62. If it is desired or necessary that bails be otherwise connected to body 12, projections 66 extend outward from body 12 perpendicular to the axes of the bowls 14. Funnel guides 68 are provided at the lower end of bowls 14 and bushings 70 are secured to funnel guides 68 with set screws 72 as shown in FIG. 3 and are interchangeable to accommodate different size tubing strings.

Figure 2:
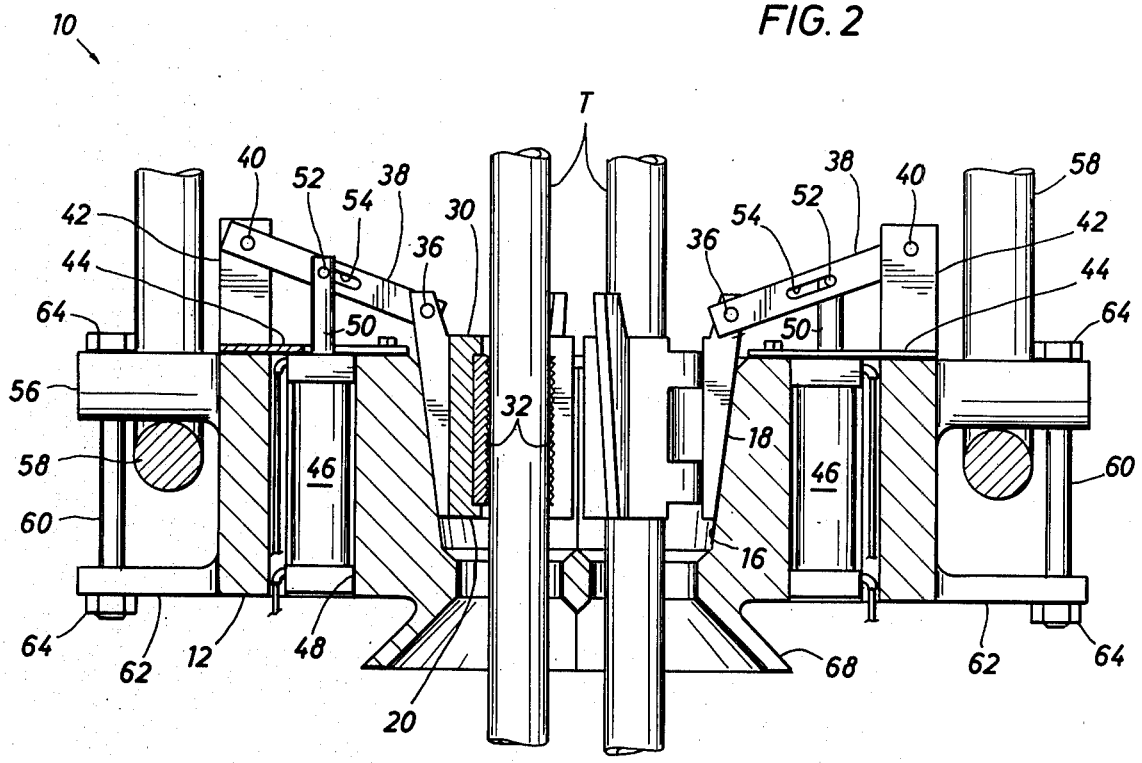
FIG. 2 is a sectional view taken through the axes of both bowls and showing the gripping elements in gripping position supporting strings extending through the bowls.

Tubing strings T are supported by gripping slips 26 in bowls 14 as shown in FIG. 2. In such position, piston rods 50 are retracted and gripping slips 26 are seated in bowls 14 with gripping elements 32 in tight supporting engagement with strings T. To release this engagement, pressure is supplied to actuators 46 to extend rods 50 as strings T are lifted. The extension of rods 50 moves link 38 and gripping slips 26 upwardly and outwardly to the position shown in FIG. 3. In this position, gripping slips 26 are moved out of bowls 14 and elevator 10 is free of any connection to the tubing strings T.

Whenever elevator 10 is to support or raise tubing strings T, slips 20, 22 and 24 are provided with fluid pressure or air to retract rod 50 to move gripping slips 26 to the position shown in FIG. 2. Thereafter, because of the taper of walls 16 of bowls 14, the weight of tubing strings T moves gripping slips 26 down in bowls 14 which tightens their supporting engagement on tubing strings T.

What is claimed is:

1. A dual string elevator comprising a body having a single pair of tapered bowls extending vertically through its central portion, said body having a pair of actuator recesses, gripping slips for each bowl, an actuator for each set of gripping slips, one of said actuators being positioned within each of said recesses, means connecting each actuator to its set of gripping slips whereby when each actuator is actuated in one direction, its gripping slips are moved out of engagement with said bowl, and when said actuator is actuated in the other direction, its slips are moved into a pipe gripping position within said bowl, brackets on said body, said connecting means including a link pivotally connected at its central portion to its respective actuator, said link being pivotally connected at its outer end to one of said brackets and at its inner end to its gripping slips, and a pair of lifting projections extending outward from said body in a position aligned with a plane passing through the axes of said bowls, whereby the load of supporting a single string in one of said bowls does not introduce a bending load on said string.

2. An elevator according to claim 1 wherein said recesses are aligned with said plane passing through the axes of said bowls and said lifting projections.

3. A dual string elevator comprising a body having a single pair of tapered bowls extending vertically through its central portion, gripping slips for each bowl, an actuator for each set of gripping slips, said body having a pair of actuator recesses, one of said actuators being positioned within each of said recesses, means connecting the actuators to their set of gripping slips whereby when each actuator is actuated in one direction its gripping slips are moved out of engagement with said bowl and when said actuator is actuated in the other direction its gripping slips are moved into a pipe gripping position within said bowl, and a pair of lifting projections extending outward from said body in a position aligned with a plane passing through the axes of said bowls whereby the load of supporting a single string in one of said bowls does not introduce a bending load on said string, said recesses being aligned with said plane passing through the axes of said bowls and said lifting projections.

* * * * *